US006438852B2

(12) United States Patent
Taomo et al.

(10) Patent No.: US 6,438,852 B2
(45) Date of Patent: Aug. 27, 2002

(54) PORTABLE POWER WORKING MACHINE

(75) Inventors: Toshio Taomo; Fujio Kobayashi, both of Tokyo (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 09/767,565

(22) Filed: Jan. 23, 2001

(30) Foreign Application Priority Data

Jan. 27, 2000 (JP) ..... 2000-018590

(51) Int. Cl.[7] ..... B27B 17/00
(52) U.S. Cl. ..... 30/383
(58) Field of Search ..... 30/381–383, 340

(56) References Cited

U.S. PATENT DOCUMENTS 5,029,561 A * 7/1991 Koga ..... 30/381 X
5,570,512 A * 11/1996 Hoppner ..... 30/383

FOREIGN PATENT DOCUMENTS

JP 2-150201 * 12/1990

* cited by examiner

*Primary Examiner*—Douglas D. Watts
(74) *Attorney, Agent, or Firm*—Baker Botts L.L.P.

(57) ABSTRACT

A portable power working machine has an L-shaped top handle having a top grip portion that extends longitudinally above and parallel to the top of a main housing and a rear coupling portion that extends along the rear portion of the main housing. A side handle has a front grip portion that is joined to and extends horizontally and laterally from the front end of the top grip portion of the top handle and a diagonal grip portion which curves out and down from the front grip portion and extends diagonally straight as viewed in side elevation from the front grip portion toward the lower end of the rear coupling portion of the top handle. A starting footstool contiguous to a lower end of the diagonal grip portion extends horizontally to the vicinity of and is joined to the lower end portion of the rear coupling portion of the top handle.

8 Claims, 6 Drawing Sheets

PORTABLE POWER WORKING MACHINE

BACKGROUND OF THE INVENTION

The present invention relates to a portable power working machine, such as a chain saw, a power cutter, a hedge trimmer and the like. Such machines ordinarily have a top handle, which is usually gripped by the operator with his right hand, and a side handle, which is usually gripped with his left hand. The handles are attached to a main housing. A working member, such as a saw chain or a cutter, extends forwardly from the main housing.

In a conventional portable power working machine of the aforementioned kind, the top handle is constituted by a top grip member, which is located above and oriented parallel to a top surface of the main housing and extends in the longitudinal direction of the main housing. The front and rear ends of the top grip member are connected with the front and rear end portions of the upper surface of the main housing, respectively. The side handle is generally a C-shaped tubular body, one end of which (the upper end) is secured to the main housing close to the front end of the top grip member, and the other end of which (the lower end) is secured to a bottom portion of the main housing, at a location vertically below where the upper end is secured to the main housing. Both ends of the side handle are secured to the main housing at about the same location in the longitudinal direction of the main housing, and therefore, the side handle lies in a vertical plane orthogonally intersecting the longitudinal direction of the main housing.

In the operation of the portable power working machine of the type described above, the working position (or posture) thereof is not necessarily the same all the time, but may be required to be varied depending on the working condition. For example, the operator may sometimes hang the working machine from a branch of a tree using a rope, for instance. Depending on the working posture, the operator may have difficulty suitably gripping the side handle, which, as mentioned above, lies in a vertical plane orthogonally intersecting the longitudinal direction of the main housing, thereby badly affecting the working efficiency.

With a view to solving the above problem, there has been proposed, as set forth in Japanese Patent Publication No. 2931234 (U.S. Pat. No. 5,570,512), a portable power working machine (a chain saw) wherein the aforementioned other end (lower end) of the side handle is secured to a lower edge portion of the proximal (rear) end of the main housing, and the central portion of the side handle is curved downwardly diagonally, as viewed from the side.

Although the side handle can be easily gripped, irrespective of the working posture of the machine, the vibrations of the top handle and the main housing are transmitted to the side handle, inasmuch as the other end (lower end) of the side handle is secured to a lower edge portion of the proximal (rear) end of the main housing (recoil starter case). Hence, the operator is not able to sense an integrity between the top and side handles, thus diminishing the operability of the machine. Furthermore, since part of the side handle extends over the main housing, it is required, when performing maintenance or repair work on components housed inside the main housing (such as maintenance and inspection of the prime mover and the recoil starter), to dismount the side handle from the top handle as well as from the main housing, thereby making the performance of maintenance inconvenient.

BRIEF SUMMARY OF THE INVENTION

The present invention has been made in view of overcoming the aforementioned problems. It is an object of the present invention to provide a portable power working machine having a side handle that is easy to grip, irrespective of the working posture of the machine. It is a further object to minimize the transmission of vibrations of the main housing to the side handle, thereby giving the operator a feeling of integrity between the top and side handles and improving the operability of the machine. Another object is to make it easier for the operator to perform maintenance work on the components housed inside the main housing.

With a view to attaining the aforementioned objects, there is provided, according to the present invention, a portable power working machine which includes a main housing having a front end portion, a working member that extends forwardly from the front end portion of the main housing, and a prime mover housed in the main housing. A top handle is secured to the main housing. The top handle is L-shaped as viewed in side elevation and has a top grip portion disposed above and extending parallel to a top surface of the main housing and in the longitudinal direction of the main housing. A rear coupling portion of the top handle extends from the top grip portion downwardly along the rear side of the main housing. The front end of the top grip portion is connected with the front end portion of the top surface of the main housing. A rear coupling portion of the top handle is coupled with a rear end portion of the main housing. A side handle includes a front grip portion, which extends horizontally and laterally from the vicinity of the front end of the top grip portion of the top handle, and a diagonal grip portion, which curves laterally and downwardly from the front grip portion and then extends diagonally straight, as viewed in side elevation, toward the lower end of the rear coupling portion of the top handle. A starting footstool is contiguous to a lower end of the diagonal grip portion and extends horizontally to the vicinity of the lower end of the rear coupling portion. One end portion of the front grip portion of the side handle is connected directly to or molded integrally with the top grip portion of the top handle at a location near the front end thereof. A rear end portion of the starting footstool is connected directly to or molded integrally with the rear coupling portion of the top handle at a location near the lower end thereof.

In preferred embodiments of the portable power working machine according to the present invention, the starting footstool is molded integrally with the side handle.

In a preferred embodiment, said one end portion of the front grip portion of the side handle is connected directly to the top grip portion of the top handle by a bolt or the like, and the rear end portion of the starting footstool is connected directly to the rear coupling portion by a bolt or the like.

Preferably, the starting footstool is configured in plan view such that the outer side wall thereof gradually converges from the front end portion thereof toward the vicinity of the rear end portion thereof so as to make it gradually approach the main housing.

In another preferred embodiment, a vibration isolating member is interposed between the vicinity of the front end of the top grip portion of the top handle and the top surface of the main housing.

In a further preferred embodiment, a vibration isolating member is interposed between the lower end of the rear coupling portion of the top handle and a lower end portion of the rear end portion of the main housing.

In a further preferred embodiment, the diagonal grip portion of the side handle has an oval cross section whose inner circumference has a larger radius of curvature than that of the outer circumference thereof.

The present invention is applicable to such portable power working machines as chain saws, power cutters, hedge trimmers, etc. In the case where the working machine is a chain saw, the working portion thereof is constituted by a saw chain set comprising a guide bar attached to the main housing and a saw chain trained around the guide bar.

According to a preferred embodiment of the portable power working machine, which is constructed according to the present invention, the top handle is L-shaped in side elevation and is constituted by a top grip portion which is located above and parallel to the top surface of the main housing and extends in the longitudinal direction of the main housing and by a rear coupling portion, which extends from the top grip portion toward the rear side of the main housing. The front end of the top grip portion is connected with the front end portion of the top surface of the main housing, and the rear coupling portion is coupled with the rear end portion of the main housing. Furthermore, the side handle is constituted by the front grip portion which extends horizontally and laterally from the vicinity of the front end of the top grip portion and by the diagonal grip portion which curves down from the front grip portion and then extends diagonally straight, in the side view thereof, from the front grip portion toward the lower end of the rear coupling portion. The end portion of the front grip portion of the side handle is connected directly to or molded integrally with the portion of the top grip portion of the top handle which is located close to the front end of the top grip portion.

Further, preferably, the starter footstool is formed integrally with and contiguous to the diagonal grip portion (or a lower end thereof) of the side handle. Since the starter footstool is disposed in this manner, the working machine can be firmly fixed in place by placing one's foot on the starter footstool on the occasion of pulling the recoil starter handle, thereby facilitating the starting of the working machine.

Furthermore, since the starter footstool extends horizontally to the vicinity of the lower end portion of the rear coupling portion and the rear end portion of the starter footstool is connected directly to or molded with the lower end portion of the rear coupling portion, the side handle is enabled, via the starting footstool, to be connected directly to or molded integrally with the lower end portion of the rear coupling portion. As a result, it is possible to make it easy to grip the side handle (the front grip portion and the diagonal grip portion) irrespective of the working posture of the machine. Further, it is possible, with a portable power working machine embodying the present invention, to give the operator a feeling of integrity between the top and side handles, thus making it possible to improve the operability of the machine as compared with the conventional portable power working machine wherein the other end (lower end) of the side handle is secured directly to a lower edge portion of the proximal (rear) end of the main housing (recoil starter case).

Furthermore, since it is no longer required, when performing maintenance on the components housed inside the main housing (such as maintenance and inspection of the prime mover and the recoil starter), to dismount the side handle from the top handle, the maintenance work can be facilitated.

Additionally, since a vibration isolating member is interposed between the vicinity of the front end of the top grip portion and the top surface of the main housing, and at the same time, since a vibration isolating member is interposed between the lower end of the rear coupling portion of the top handle and a lower end portion of the rear end portion of the main housing, vibration of the top and side handles can be minimized, thus giving the operator a feeling of improved integrity and making it possible to improve the operability of the working machine.

DESCRIPTION OF THE EMBODIMENT

The illustrated embodiment of the present invention will be explained with reference to the attached drawings as follows.

Figure 1:
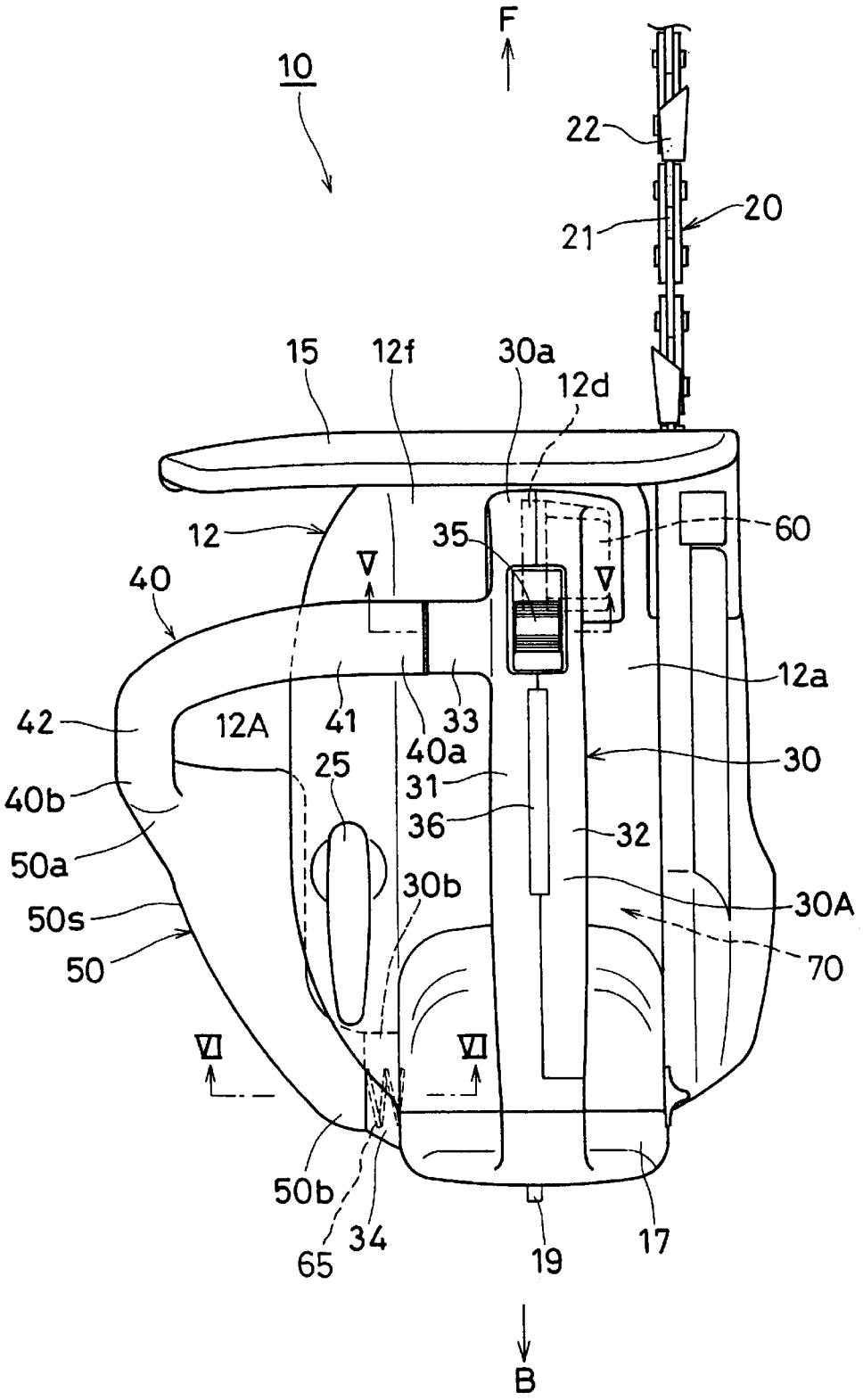
FIG. 1 is a plan view showing one embodiment of a chain saw, which is representative of portable power working machines according to the present invention.
Figure 2:
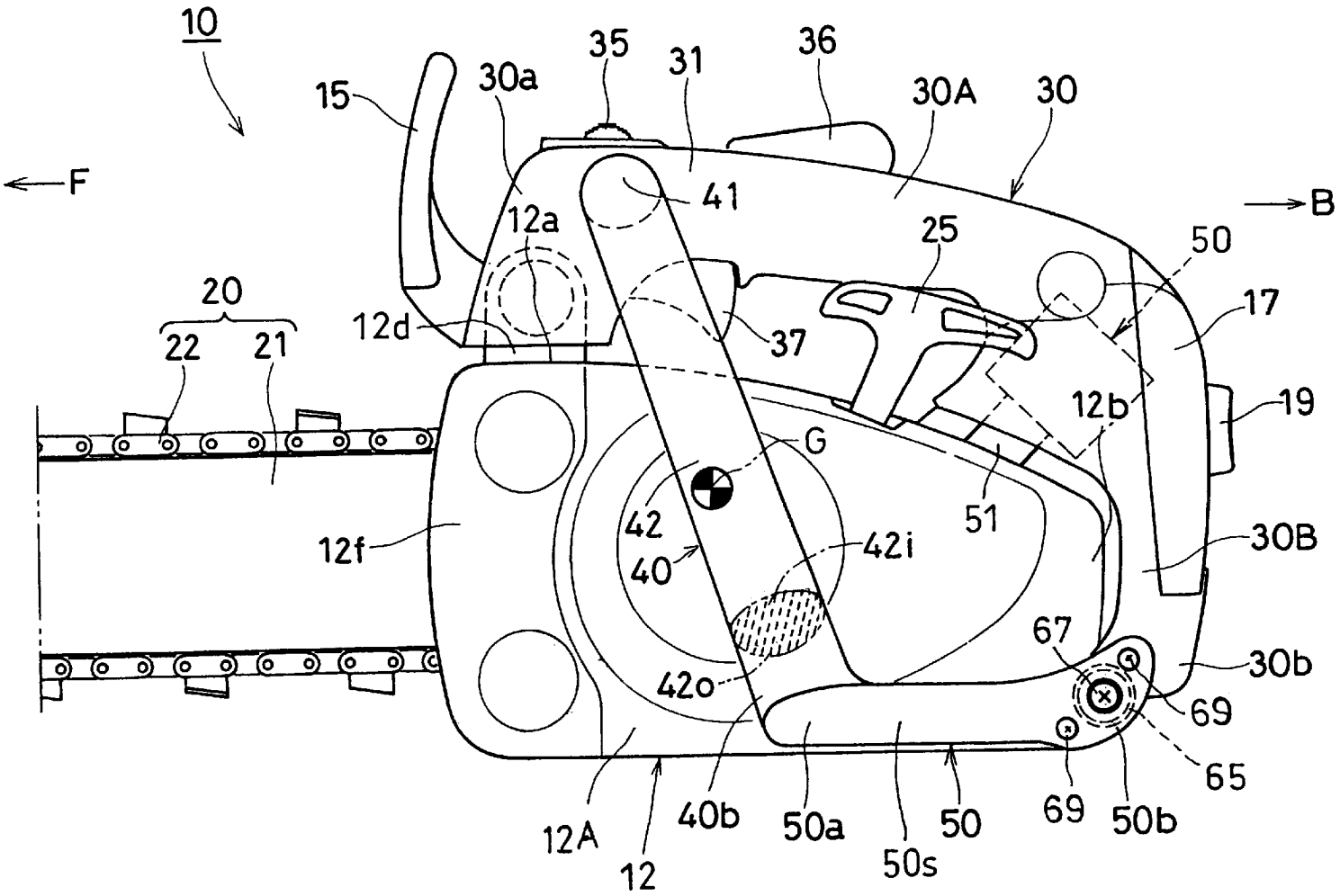
FIG. 2 is a left side view of the chain saw shown in FIG. 1.
Figure 3:
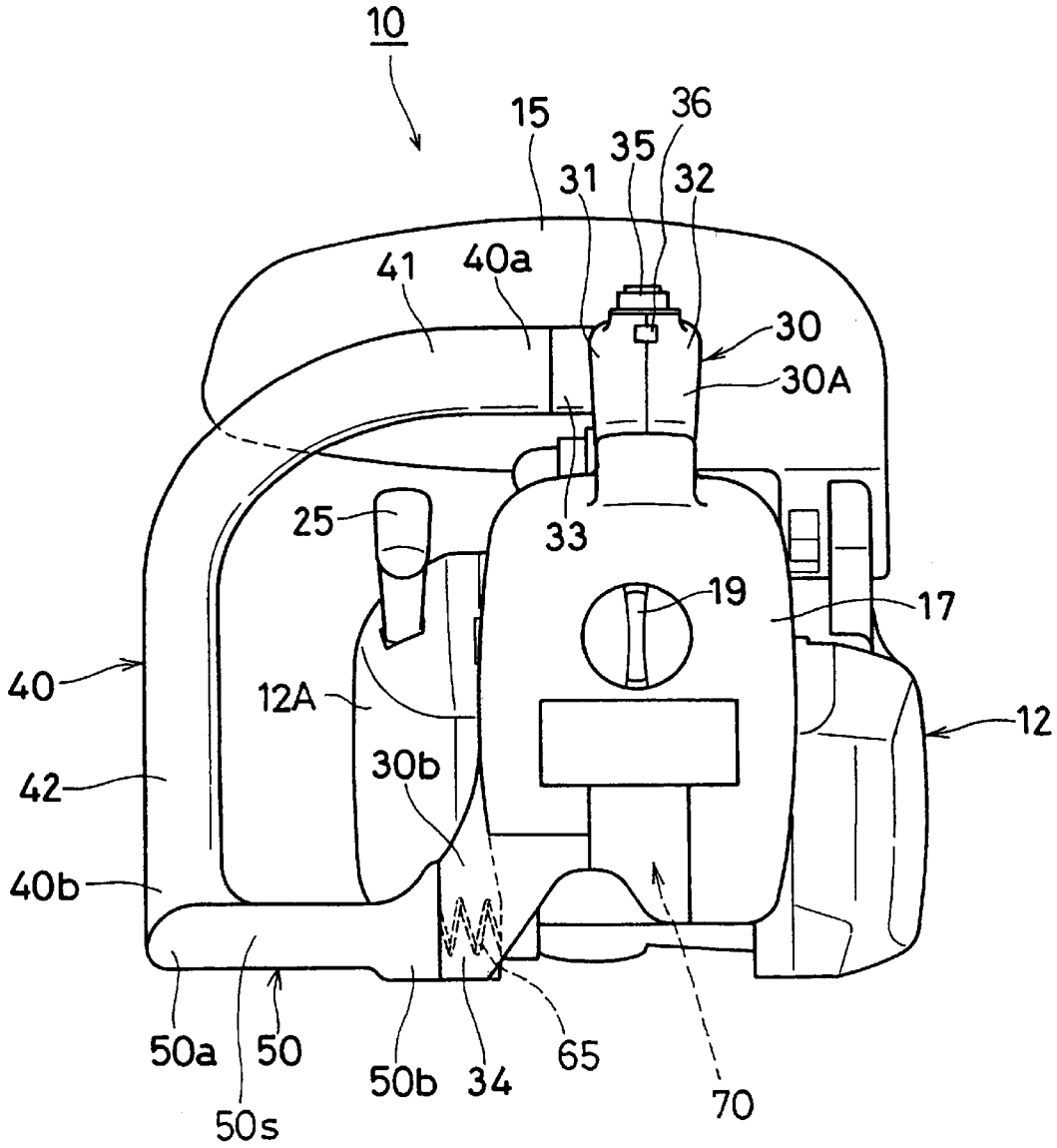
FIG. 3 is a rear side view of the chain saw shown in FIG. 1.

Referring to FIGS. 1, 2 and 3, a chain saw 10 comprises a main housing 12 made of a synthetic resin, and a guide bar 21 around which a saw chain 22 is trained so as to constitute a working member (working portion). The guide bar 21 extends forwardly (the arrow F) from a right portion of the front end 12f of the main housing 12.

An air-cooled two-stroke gasoline engine 70, the details of which are omitted, serves as a prime mover by rotatably driving the saw chain 22. The engine 70 is housed inside the main housing 12. A recoil starter case 12A is detachably attached to the left sidewall of the main housing 12 and includes a recoil starter handle 25 at a rear portion on the left side of the engine 70 for starting the engine 70. A hand protection guard 15 is disposed over the front end 12f of the housing.

A top handle 30 of L-shape in side elevation is located above the top surface 12*a* of the main housing 12 and extends from the front portion to the rear portion 12*b* of the main housing 12. Further, a side handle 40 is disposed on the left side of the main housing 12 (on the side where the recoil starter case 12A is disposed).

Figure 6:
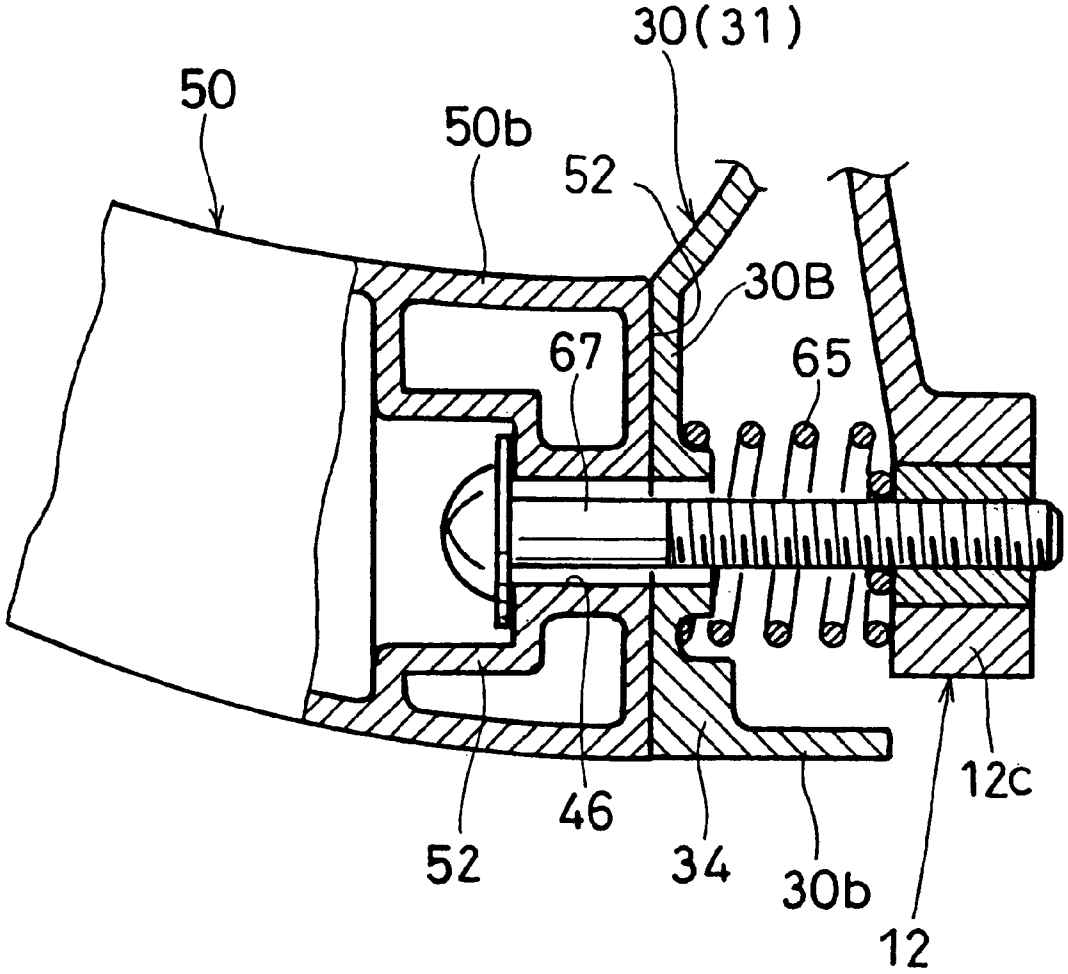
FIG. 6 is a cross-sectional view taken along the line VI—VI of FIG. 1.

The top handle 30 is constituted by a top grip portion 30A, which is located above and extends parallel to the top surface 12*a* of the main housing 12 and in the longitudinal direction of the main housing 12, and by a rear coupling portion 30B, which extends from the top grip portion 30A toward the rear side of the main housing 12. A front end 30*a* of the top grip portion 30A is connected via a vibration isolating member 60 with a bracket 12*d*, which projects upwardly from the top surface 12*a*. The lower end 30*b* of the rear coupling portion 30B is coupled with a lower end 12*c* of the rear end portion 12*b* of the main housing 12 by means of a bolt 67 (see FIG. 6).

The top handle 30 is of a two-piece structure, consisting of a left side half body 31 and a right side half body 32. The left side half body 31 is constituted by the left side half of the top grip portion 30A and by the rear coupling portion 30B, while the right side half body 32 is constituted only by a right half of the top grip portion 30A. The top grip portion 30A is provided with an engine stop switch 35, a throttle safety lever 36 and a throttle trigger 37. On the rear side of the rear coupling portion 30B, there is detachably mounted an air cleaner cover 17 equipped with a detaching thumbscrew 19. The interior of the rear coupling portion 30B houses a diaphragm carburetor 50 for feeding an air-fuel mixture to the engine 70 through a flexible tube 51.

The side handle 40 is tubular in configuration and is constituted by a front grip portion 41, which extends horizontally and leftward from the vicinity of the front end 30*a* of the top grip portion 30A, and by a diagonal grip W portion 42, which curves downwardly from the front grip portion 41 and after passing through nearly the center of gravity G of the working machine further extends diagonally straight (in the side view thereof) toward the lower end of the rear coupling portion 30B. A constricted portion 40a of the front grip portion 41 is inserted into an inner partitioning wall 33*a* of a coupling boss 33, which projects in the vicinity of the front end 30*a* of the top grip portion 30A, thereby enabling the front grip portion 41 to be integrally connected, by a bolt 62 or the like (FIG. 5), with the top grip portion 30A.

A starter footstool 50 of triangular configuration in the plan view thereof is disposed contiguous to a lower end (the other end) of the diagonal grip portion 42 of the side handle 40 and horizontally extended up to the vicinity of the lower end portion 30*b* of the rear coupling portion 30B. The rear end portion 50*b* of the starter footstool 50 is integrally connected, by bolts or the like, with a coupling boss 34 which projects in the vicinity of the lower end portion 30*b* of the rear coupling portion 30B.

The starting footstool 50 is configured in plan view such that the outer sidewall 50*s* thereof gradually converges from the front end portion 50*a* thereof toward the vicinity of the rear end portion 50*b* thereof so as to make it gradually approach the main housing 12. The converging sidewall 50*s* prevents the working machine 10 from being caught by the branches of a tree when, for example, it is hung by a rope from a tree.

Figure 4:
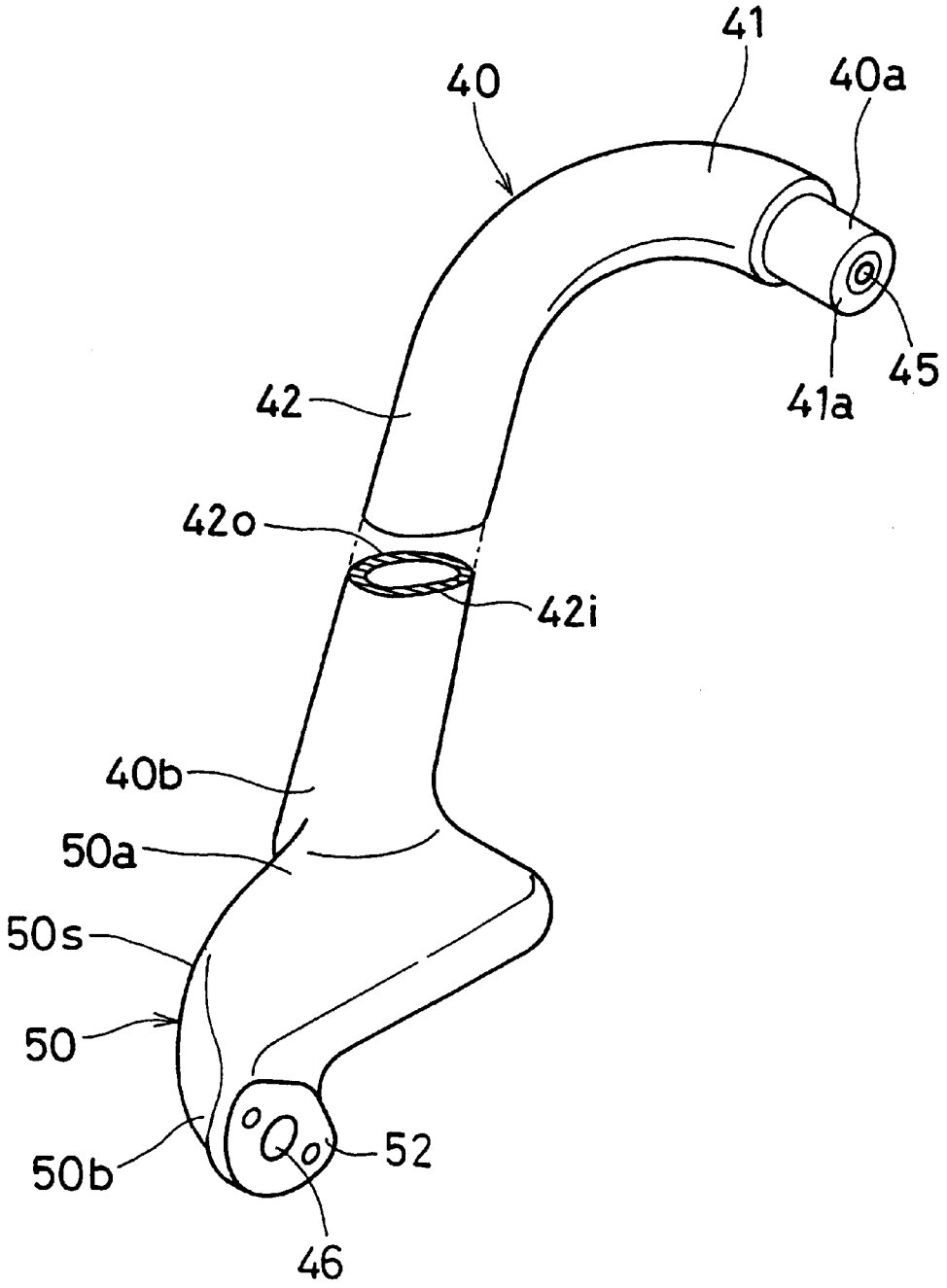
FIG. 4 is a perspective view, illustrating the side handle and the starting footstool, which are mounted on the chain saw shown in FIG. 1.

For the purpose of enabling the operator to easily grip the side handle 40, as shown in FIG. 2 (hatched region) and FIG. 4, the diagonal grip portion 42 of the side handle 40 is made oval in cross-section (nearly flattened) in such a manner that the inner circumference 42*i* has a radius of curvature larger than that of the outer circumference 420 thereof (the side which is contacted by the palm of the operator's hand).

Figure 5:
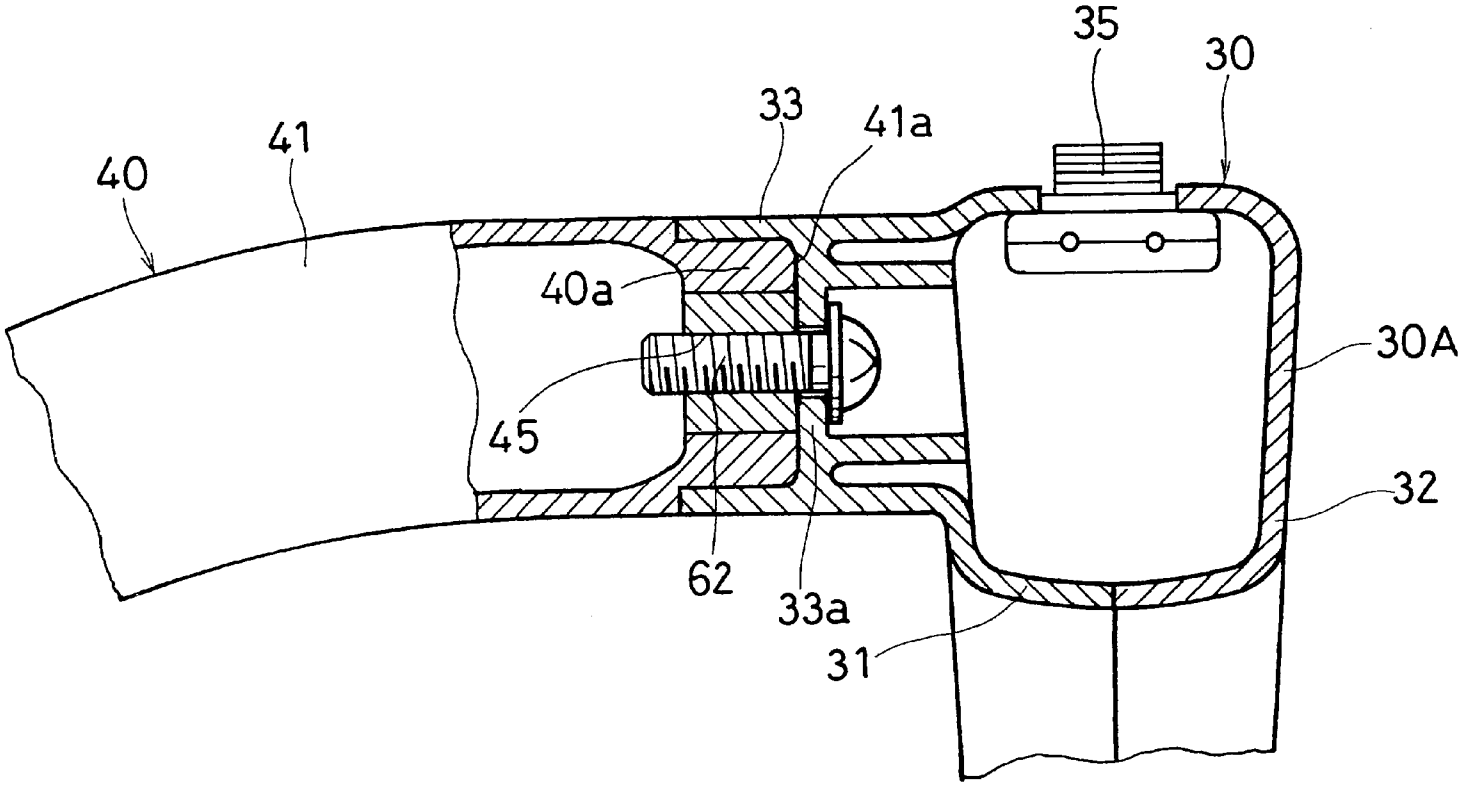
FIG. 5 is a cross-sectional view taken along the line V—V of FIG. 1.

As shown in FIGS. 4 to 5, the side handle 40 is provided, at the end portion 40*a* thereof, with an end wall 41a having a tapped hole 45, and the starting footstool 50 is provided, at the rear end 50*b* thereof, with an end wall 52 having a bolthole 46.

Further, the coupling boss 34, which projects in the vicinity of the lower end 30*b* of the rear coupling portion 30B of the top handle 30 and to which the end wall 52 of the rear end (the other end) 50*b* of the starting footstool 50 is attached, is interconnected, by means of bolts 67 or the like, with the lower end 12*c* of the rear portion 12*b* of the main housing 12 with a vibration isolating spring 65 being interposed therebetween.

With the chain saw 10 of the embodiment, which is constructed as described above, the top handle 30 is L-shaped in the side view thereof and is constituted by the top grip portion 30A which is located above and parallel to the top surface 12*a* of the main housing 12 and extends in the longitudinal direction of the main housing 12 and by the rear coupling portion 30B which extends from the top grip portion 30A toward the rear side of the main housing 12. The front end 30*a* of the top grip portion 30A is connected with a front end portion 12*f* of the top surface 12*a*, and the rear coupling portion 30B is coupled with a rear end portion 12*b* of the main housing 12. The side handle 40 is constituted by a front grip portion 41, which extends horizontally and laterally from the vicinity of the front end 30*a* of the top grip portion 30A of the top handle 30, and by a diagonal grip portion 42 which curves out and down from the front grip portion 41 and then extends diagonally straight in the side view thereof toward the lower end of the rear coupling portion 30B. The one end portion 40*a* of the front grip portion 41 is connected directly with the coupling boss 33, which projects close to the front end 30*a* of the top grip portion 30A.

The starting footstool 50 is integrally connected with the lower end 40*b* of the diagonal grip portion 42 of the side handle 40. Since the starter footstool 50 is disposed in this manner, the working machine 10 can be firmly fixed in place by placing one's foot on this starter footstool 50 at the time of pulling the recoil starter handle 25, thereby facilitating the starting of the working machine 10.

Since the starter footstool 50 extends horizontally to the vicinity of the lower end portion 30*b* of the rear coupling portion 30B and the rear end portion 50*b* of the starter footstool 50 is integrally connected with the lower end portion 30*b* of the rear coupling portion 30B, the side handle 40 is enabled, via the starting footstool 50, to be connected directly with the lower end portion 30*b* of the rear coupling portion 30B. As a result, the side handle 40 (the front grip portion 41 and the diagonal grip portion 42) is easy to grip, irrespective of the working posture of the machine. Also, the operator of the portable power working machine 10 receives a feeling of integrity between the top and side handles 30 and 40, thus making it possible to improve the operability of the machine 10 as compared with the conventional portable power working machine wherein the other end (lower end) of the side handle is secured to a lower edge portion of the proximal (rear) end of the main housing (recoil starter case).

Since the members mounted on the main housing 12, such as the recoil starter case 12A, are attached independently of the handles 30 and 40, it is no longer required, when performing maintenance on components housed inside the main housing 12 (such as maintenance and inspection of the prime mover 70 and the recoil starter 25), to dismount the side handle 40 from the top handle 30, so that the maintenance work can be facilitated.

In as much as the vibration isolating member 60 is interposed between the vicinity of the front end 30*a* of the top grip portion 30A and the top surface 12*a* of the main housing 12, and at the same time, since the vibration isolating spring 65 is interposed between the lower end 30*b* of the rear coupling portion 30B and a lower end portion 12*c* of the rear end portion 12*b* of the main housing 12, the vibration of both handles 30 and 40 can be minimized, thus giving the operator a feeling of improved integrity, and making it possible to improve the operability of the working machine 10.

While the foregoing embodiment of the present invention has been described in detail above for the purpose of illustration, it will be understood that the construction of the device can be varied without departing from the spirit and scope of the invention.

For example, although the embodiment is a chain saw, the present invention is also applicable to other kinds of portable power working machines, such as power cutters and hedge trimmers.

Further, although the top handle is formed as a separate body from the side handle in the above embodiment, they can be integrally formed.

As explained above, according to the portable power working machine of the present invention, in addition to the advantage of facilitating the starting of the engine owing to the provision of the footstool, it is now possible to easily grip the side handle irrespective of the working posture of the machine, to restrict transmission of vibrations of the main housing to the side handle, thereby giving the operator a feeling of integrity between the top and side handles and improving the operability of the machine, and to make it convenient for the operator to perform maintenance work on the components housed inside the main housing.

What is claimed is:

1. A portable power working machine, comprising:

(a) a main housing having a front end portion;

(b) a working member projecting forwardly from the front end portion of the main housing;

(c) a prime mover housed in the main housing;

(d) a top handle of L-shape in side elevation and including a top grip portion located above and extending over and parallel to a top surface of the main housing and extending in a longitudinal direction of the main housing, a rear coupling portion extending from the top grip portion along a rear side of the main housing, a front end of the top grip portion being connected with a front end portion of the top surface of the main housing, and the rear coupling portion being coupled with a rear end portion of the main housing;

(e) a side handle having a front grip portion which extends horizontally and laterally from the vicinity of the front end of the top grip portion, and a diagonal grip portion which curves out and down from the front grip portion and extends diagonally straight as viewed in side elevation toward the lower end of the rear coupling portion of the top handle; and (f) a starting footstool formed contiguously to a lower end of the diagonal grip portion and extending horizontally to the vicinity of the lower end portion of the rear coupling portion of the top handle;

wherein one end portion of the front grip portion of the side handle is connected directly to or molded integrally with the top grip portion of the top handle at a location close to the front end thereof, and a rear end portion of the starting footstool is connected directly or molded integrally with the rear coupling portion of the top handle at a location close to the lower end thereof.

2. The portable power working machine according to claim 1, wherein the starting footstool is molded integrally with the side handle.

3. The portable power working machine according to claim 1, wherein said one end portion of the front grip portion of the side handle is connected directly to the top grip portion of the top handle by a bolt, and said rear end portion of the starting footstool is connected directly to the rear coupling portion of the top handle by a bolt.

4. The portable power working machine according to claim 1, wherein the starting footstool is configured in plan such that the outer sidewall thereof converges gradually from the front end portion thereof toward the vicinity of the rear end portion thereof so as to make it gradually approach the main housing.

5. The portable power working machine according to claim 1, wherein a vibration isolating member is interposed between the front end of the top grip portion and the top surface of the main housing.

6. The portable power working machine according to claim 1, wherein a vibration isolating member is interposed between the lower end of the rear coupling portion of the top handle and a lower end portion of the rear end portion of the main housing.

7. The portable power working machine according to claim 1, wherein the diagonal grip portion of the side handle has an oval cross section whose inner circumference has a larger radius of curvature than that of the outer circumference thereof.

8. The portable power working machine according to claim 1, wherein the working member is a chain saw set having a guide bar attached to the main housing, and a saw chain trained around the guide bar.

* * * * *